United States Patent [19]

Young

[11] Patent Number: 4,743,928

[45] Date of Patent: May 10, 1988

[54] DAYLIGHT CASSETTE ADAPTER FOR FILM PROCESSOR

[75] Inventor: Rickie L. Young, Kendallville, Ind.

[73] Assignee: The Howard Company, Inc., Fort Wayne, Ind.

[21] Appl. No.: 530

[22] Filed: Jan. 5, 1987

[51] Int. Cl.[4] ..... G03D 13/06

[52] U.S. Cl. ..... 354/310

[58] Field of Search ..... 354/310, 311, 312, 313, 354/314

[56] References Cited

U.S. PATENT DOCUMENTS

| | | | |
|---|---|---|---|
| 3,702,408 | 3/1973 | Horn | 354/312 |
| 4,049,142 | 9/1977 | Azzaroni . | |
| 4,164,371 | 8/1979 | Viehrig et al. | 354/312 |
| 4,218,123 | 8/1980 | Viehrig et al. | 354/310 |
| 4,311,379 | 1/1982 | Falomo | 354/313 |
| 4,363,548 | 12/1982 | Oberhoffner et al. | 354/310 |
| 4,406,534 | 9/1983 | Viehrig et al. | 354/310 |
| 4,480,423 | 11/1984 | Muller . | |

*Primary Examiner*—A. A. Mathews

*Attorney, Agent, or Firm*—Jeffers, Hoffman & Niewyk

[57] ABSTRACT

A daylight cassette adapter for a photographic processor which may be mounted directly on the processor. The cassette provides an enclosure into which photographic cassettes may be loaded whereby cassettes of various size may be developed in daylight by the processor. The adapter also includes a hinged lid, the sides of which form light seals with the walls of the adapter housing. The adapter is particularly useful with processors which are adapted to handle only a particular size or type of cassette and adapts the processor to use various sizes and types of cassettes.

8 Claims, 2 Drawing Sheets

DAYLIGHT CASSETTE ADAPTER FOR FILM PROCESSOR

BACKGROUND OF THE INVENTION

This invention relates to a daylight cassette adapter for an automatic photographic processor. More particularly, this invention relates to a daylight cassette adapter for adapting a photoprocessor so that it may accept cassettes of various sizes and process them in daylight.

Photographic processors for automatically and rapidly processing photographic materials are well known in the prior art. Examples of such photographic processors are Models 42A and 65A marketed by the Eastman Kodak Company of Rochester, N.Y. These processors permit rapid processing of photographic material such as rolls of photographic material commonly packaged in cassettes. A common use for such processors is in the processing and developing of typesetting material for electronic typesetting devices. Such processors may be adapted for daylight processing so that the processor need not be placed in a darkroom. Such processors generally includes an enclosure into which the cassette is placed and a lid for closing the enclosure. A leader portion of the cassette is fed into a slot in the processor, after which the lid of the enclosure is shut. The processor will now be able to process and develop the cassette photographic material. The developing may be done in a daylight environment because the cassette is enclosed in the enclosure which is sealed against light leakage.

A problem with the prior art known processors is that only cassettes of a certain size may be accepted in the processor cassette enclosure. For instance, in the Kodak processor Model 42A identified above, only cassettes of twelve and one-half (12½) inches in length can be processed. Larger cassettes can not be processed because the enclosure is not large enough to accept them. This is a serious disadvantage and limits the use of the processor to daylight processing of only cassettes of a particular size. If it were desired to process larger cassettes, this could be accomplished by placing the processor in a dark room. However this is a disadvantage as it requires a special darkroom and further because it is more difficult to operate the processor in a dark room than in daylight. There is therefore a need to provide an adapter for processors which are limited to accepting only cassettes of a certain size whereby cassettes of various sizes may be processed by the processor.

Cassette adapters for photographic processors have previously been provided. Such adapters have generally been rather complicated and expensive to manufacture. Further, such adapters have generally been adapted for specific sizes of cartridges or for use with specific processors. Another disadvantage of the prior art adapters has been that such processors are limited to use with particular cassettes manufactured by only a single manufacturer. There is therefore a need for a simple, inexpensive and effective adapter which is adaptable to various kinds of processors and which may, in particular, be used with the above identified or similar types of processors such as Kodak Models No. 42A and No. 65A sold or marketed by the Eastman Kodak Company of Rochester, N.Y.

SUMMARY OF THE INVENTION

The present invention, in one form thereof, overcomes the disadvantages of the above described prior art cassette adapters by providing an improved daylight cassette adapter therefor. The cassette adapter of the present invention comprises a two part housing which forms an enclosure. The first part of the housing is slightly wider than the cassette receiving enclosure of the processor and has an aperture in the bottom wall thereof which aligns with the processor cassette receiving enclosure. The processor normally has upstanding walls which surround the cassette receiving enclosure and the aperture is designed to receive these up standing walls thereinto.

The above identified Kodak processors have controls located adjacent to cassette receiving enclosures. The first portion of the adapter housing is small enough so that it does not interfere with the controls. The second portion of the housing is larger than the first portion of the housing whereby the second portion of the housing can receive wider cassettes than the processor cassette receiving enclosure. A cover is hingedly secured to the housing whereby the housing may be opened, the cassettes may be loaded thereinto and the cover may be sealed with the housing. After loading a cassette and feeding a leader portion of the cassette into the processor, the cover may be closed, thereby providing an enclosure into which light cannot leak.

An important advantage of the present invention is the fact that the adapter is simple to install. Apertures are provided in the adapter through which bolts or other suitable threaded fasteners extend for engagement with the processor. Thus, the adapter may be installed in only a matter of minutes by simply fitting it over the normal processor cassette receiving enclosure and threading the fasteners into place.

A further advantage of the present invention is that the processor need not be modified to accept the cassette adapter.

A still further advantage of the present invention is that the adapter permits the processor to be operated in daylight with cassettes which are larger than cassettes for which the processor was designed.

A yet further advantage of the present invention is that it is simple in construction and inexpensive to manufacture.

The present invention, in one form thereof, provides a daylight cassette adapter for use with a film processing apparatus. The processing apparatus includes an enclosed space for receiving a cassette and further includes a feed aperture for receiving photographic sheet material from the cassette. The adapter includes a housing to form an enclosure. The housing includes a first portion having substantially the same width of the enclosed cassette receiving space of the processor. The first portion of the housing includes an aperture in the bottom wall thereof which is sealingly disposed in registry with the cassette enclosed space of the processor to prevent light from entering the enclosure. The housing includes a second portion having a greater width than the first portion and which is adapted to receive cassettes therein. A cover is operatively associated with the housing to sealingly close the enclosure to enable the loading of cassettes into the enclosure when the cover is in the open position and to prevent light from entering the enclosure in the closed position of the cover.

The present invention, in one form thereof, provides a daylight cassette adapter for use with a photographic processing apparatus, the processing apparatus includes an enclosed space for receiving a cassette and a plurality of upstanding walls which are arranged around the enclosed space. A feed aperture is also provided in the enclosed space for receiving photographic sheet material from a cassette. The adapter includes a housing to form an enclosure including a first member. The first member has substantially the same width as the enclosed space of the processor. The first member includes an aperture in the bottom wall thereof to receive the upstanding walls of the enclosed cassette receiving space of the processor and to form a light seal therewith. The housing includes a second member having a greater width and height than the first member and which is dimensioned to receive cassettes which are wider than the enclosed space of the processor. A cover is hingedly secured to the enclosure. The size of the cover overlaps the size of the housing to form a light seal therewith. A light sealing strip is disposed between the front edge of the enclosure and the cover to form the light seal, whereby cassettes having a greater width than the enclosed cassette receiving space of the processor may be loaded into the housing for daylight processing of the cassette.

It is an object of the present invention to provide a daylight cassette adapter for a photographic processor whereby the processor may be used for daylight processing of cassettes of various sizes.

Another object of the present invention is to provide a daylight cassette adapter for a photographic processor which is simple in construction.

A still further object of the present invention is to provide a daylight cassette adapter for a photographic processor which is easy to use.

Yet another object of the present invention is to provide a daylight cassette adapter for a photographic processor whereby the processor need not be modified to accept the adapter.

Still another object of the present invention is to provide a daylight cassette adapter for a photographic processor which mounts on the front of the processor whereby easy access is provided to the adapter for loading cassettes thereinto.

BRIEF DESCRIPTIONS OF THE DRAWINGS

The above mentioned and other features and objects of this invention and the manner of obtaining them will become more apparent and the invention itself will be better understood by reference to the following description of an embodiment of the invention, taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
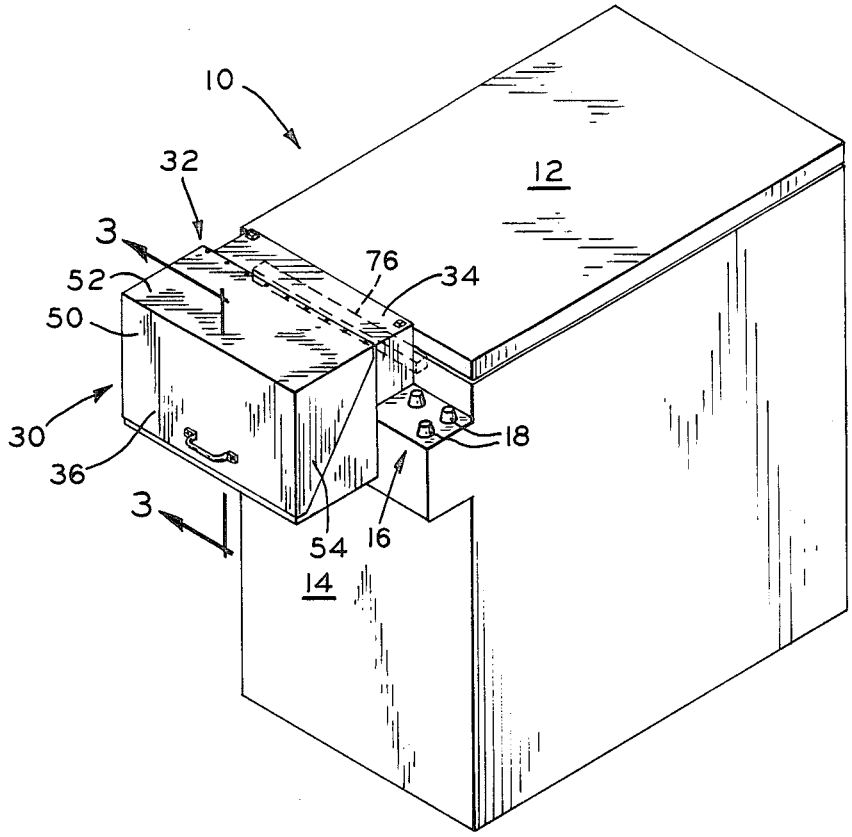
FIG. 1 is a perspective view of a photographic processor with the daylight cassette adapter mounted thereon.
Figure 2:
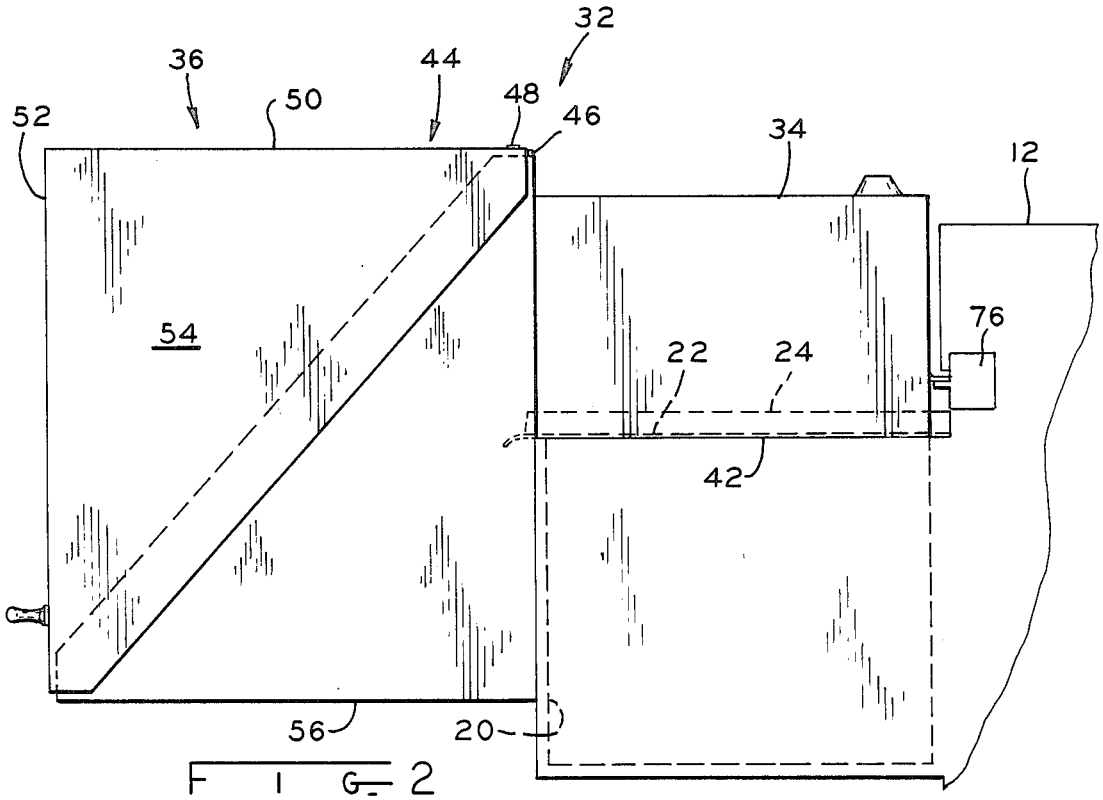
FIG. 2 is an enlarged side view of the adapter and a broken away portion of the processor.
Figure 3:
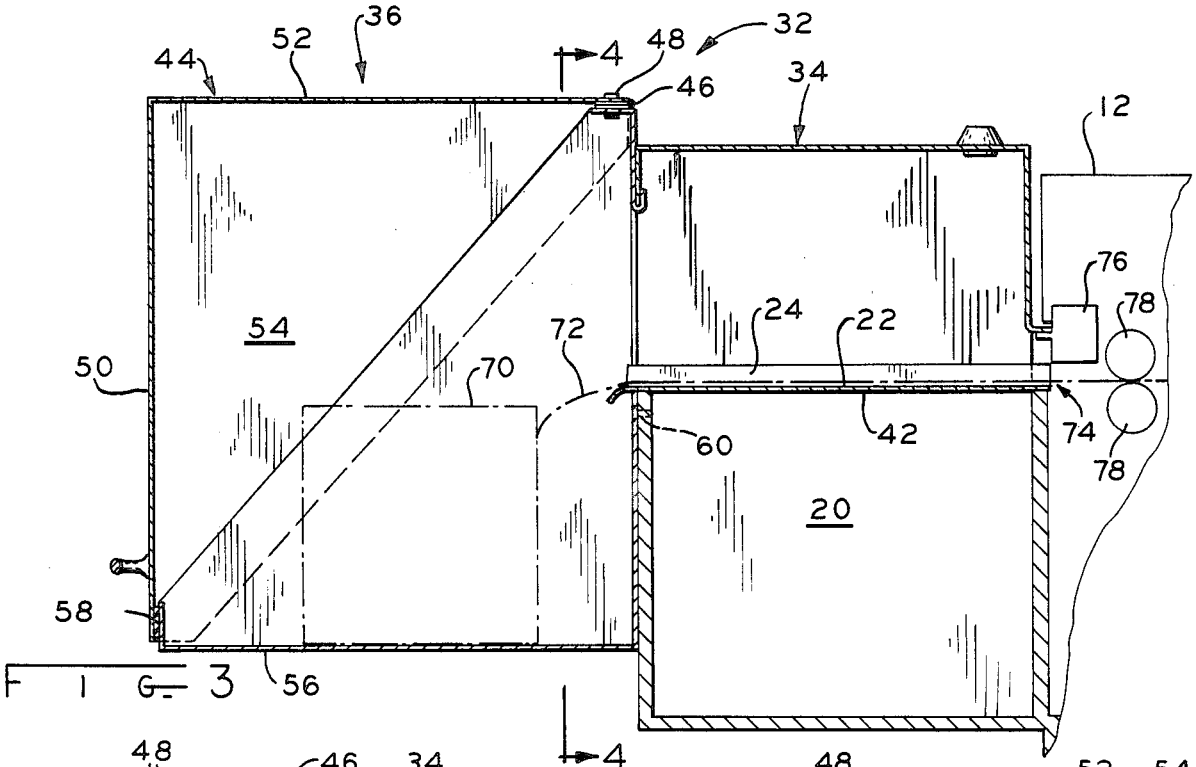
FIG. 3 is a cross sectional view of the adapter of FIG. 2 taken along lines 3—3 of FIG. 1.
Figure 4:
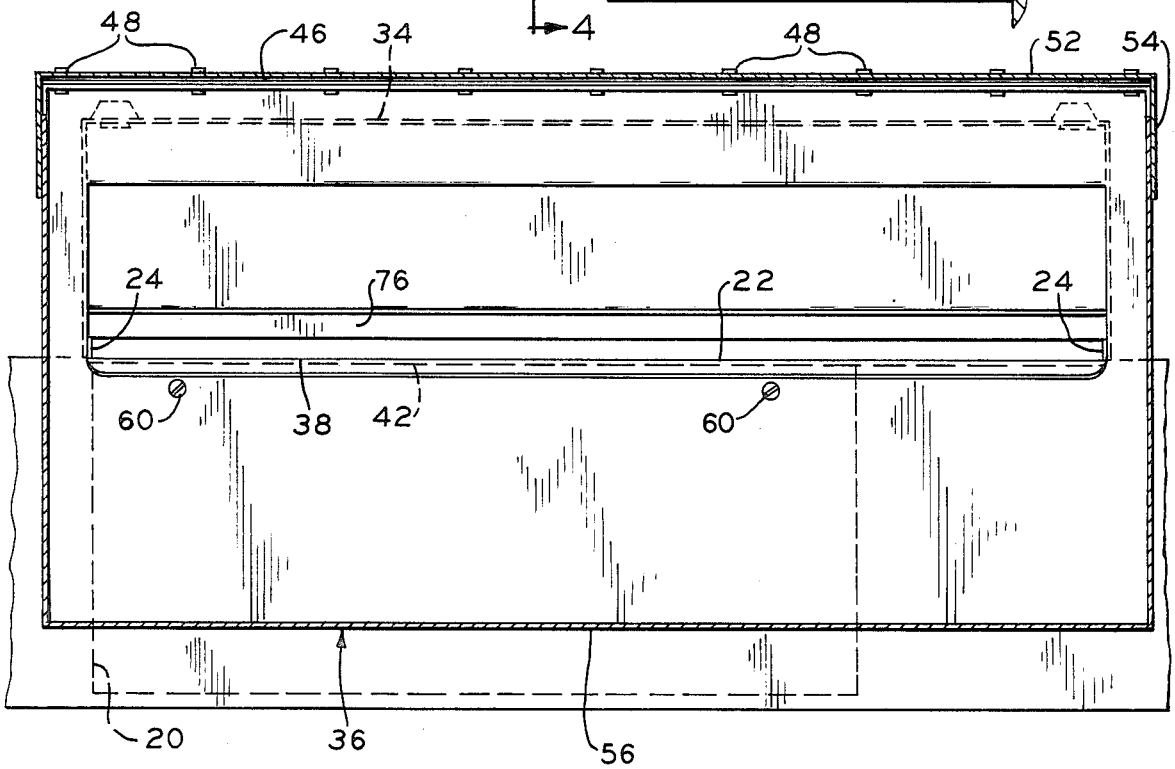
FIG. 4 is a cross sectional view of the adapter of FIG. 2 taken along lines 4—4 of FIG. 3.

Referring now to FIG. 1, there is shown an example of a processor such as, for instance, Kodak photographic processor model 42A manufactured by the Eastman Kodak Company of Rochester, N.Y. Processor 10 includes a top surface 12 and a front surface 14. Also provided on the front of processor 10 is a control 16 including an upper panel which has a number of control knobs 18 mounted thereon. Processor 10 is so constructed that a number of controls 18 are located on both the left hand side and the right hand side of control housing 16. Referring further to FIG. 2 and FIG. 4, it can be seen that processor 10 also includes a cassette receiving enclosure 20 comprising a well located inside the control housing 16. The well is located between the left hand controls and right hand controls 18. The well includes a lid 22 for closing the well 20. As best seen in FIG. 4, the walls of enclosure 20 extend above the top surface of control panel of control housing 16 at 24 so that lid 22 may properly seal the upper opening of control housing 16. Thus, processor 10 is adapted for daylight operation whereby a cassette which includes photographic material to be developed may be placed in enclosure 20, a portion of the leader of the cassette may be fed into a slot in enclosure 20 and into the interior of the processor. Lid 22 may then be closed and the processor can then be energized to develop the photographic material while the entire processor is exposed to daylight.

Referring now to FIGS. 1–4, a daylight cassette adapter 30 is provided including a housing 32. Housing 32 includes a rear portion 34 and a front portion 36. As best seen in FIG. 4, rear portion 34 includes an aperture 38 in its bottom wall 42 whereby the entire adapter may be set on top of control housing 16 so that the walls 24 of the processor cassette enclosure extend through aperture 38. Rear portion 34 of adapter 30 is only slightly wider than enclosure 20 so that it is adapted to fit between controls 18. Front portion 36 of housing 32 has a cover 44 secured thereto by means of a hinge 46. Hinge 46 may be any suitable hinge. In the disclosed embodiment, the hinge is a piano hinge which is secured to cover 44 and front portion 36 of the housing by means of spot welds as indicated at 48. Cover 44 includes a front wall 50, a top wall 52 and triangular side walls 54. It can be clearly seen that side walls 54 of cover 44 overlap the side walls of front portion 36 whereby a light seal is effected between the side walls of cover 44 and front portion 36 of housing 32. Furthermore, a sealing element 58 is disposed between cover 44 and front portion 36 of the housing, thereby effecting a further seal between cover 44 and housing 32. Cover 44 also includes a handle whereby the cover may be grasped by the operator and lifted or closed.

Thus, it can be clearly seen in FIG. 4 that the width of front portion 36 of the housing is greater than the width of processor cassette enclosure 20. Cassettes having a greater width than cassette enclosure 20 may therefore be loaded into housing 32, a portion of the leader of the cassette is fed into the processor, lid 44 is closed and the processor, including the adapter 30, may then be operated in a daylight environment while a cassette is being developed. Adapter 30 may be secured to processor 10 by any suitable method such as by means of threaded fasteners 60 which extend through apertures in adapter 30.

In operation, after the adapter has been located on the processor so that walls 24 of enclosure 20 extend into aperture 38 and into rear portion 34 of the housing 32, fasteners 60 are secured. Thus the front portion 36 of adapter 30 overhangs control housing 16 of processor 10. Lid 22 of enclosure 20 may be adjusted whereby a feed slot in the processor is exposed. Cover 44 is opened and a cassette 70 is placed into front portion 36. The leader 72 of the cassette 70 is guided into the feed slot 74 of processor 10, the cover 44 is closed and processor 10 is turned on. The leader 72 passes by sensor 76 and between rollers 78 so that the photograpnic material will be developed while the processor is exposed to daylight ambient conditions.

What has therefor been disclosed is a very advantageous, simple and economical adapter for use with a processor whereby the processor may be adapted to handle photographic cassettes larger than the cassettes for which the processor was designed.

While this invention has been described as having a preferred design, it will be understood that it is capable of further modification. This application is therefore intended to cover any variations, uses, or adaptions of the invention following the general principles thereof and including such departures from the present disclosure as come within known or customary practice in the art to which this invention pertains and fall within the limits of the appended claims.

What is claimed is:

1. A daylight cassette adapter for use with a film processing apparatus, said apparatus including an enclosed space for receiving a cassette and a feed aperture for receiving photographic sheet material from the cassette, said adapter comprising:

a housing for forming an enclosure and including a first portion having substantially the same width as the enclosed cassette receiving space of a processing apparatus, said first portion having an aperture therein adapted to be sealingly disposed in registry with the cassette enclosed space of said processing apparatus to prevent light from entering said enclosure, said housing including a second portion having a greater width than said first portion and adapted to receive cassettes thereinto;

a cover operatively associated with said housing for sealingly closing said enclosure to enable loading of cassettes into said enclosure when said cover is in the open position and to prevent light from entering said enclosure in the closed position of said cover.

2. The adapter as set forth in claim 1 including a hinge for pivotably securing said cover to said housing.

3. The adapter as set forth in claim 1 wherein said cover comprises a planar rectangular front member, a planar rectangular top member having one edge secured to a front edge of said front member, and two planar triangular side members, each said side member having two side edges respectively secured to each said front and top members, said side members adapted to overlie the sides of said housing and forming a light seal therewith.

4. The apparatus according to claim 3 including a light sealing member arranged between the front member of said cover and the front surface of said housing to prevent light from entering said enclosure when said cover is in its closed position.

5. The adapter according to claim 1 including means for securing said adapter to a processor.

6. A daylight cassette adapter for use with a photographic processing apparatus, said processing apparatus including an enclosed space for receiving a cassette, a plurality of upstanding sides arranged around said enclosed space, and a feed aperture for receiving photographic sheet material from a cassette, said adapter comprising:

a housing for forming an enclosure and including a first member, said first member having substantially the same width as the enclosed space of said processing apparatus, said first member having a bottom wall, said first member including an aperture in the bottom wall thereof for receiving the upstanding walls of the enclosed cassette receiving space of a processing apparatus and forming a light seal therewith, said housing including a second member having a greater width and height than said first member, said second member dimensioned to receive cassettes which are wider than the enclosed space of a processor;

a cover hingedly secured to said enclosure, the sides of said cover adapted to overlap the sides of said housing to form a light seal therewith; and a light sealing strip disposed between a front edge of said enclosure and said cover to form a light seal, whereby cassettes having a greater width than the enclosed cassette receiving space of said processing apparatus may be loaded into said housing for daylight processing of said cassettes.

7. The adapter as set forth in claim 6 including means for securing said adapter to a processing apparatus.

8. The adapter as set forth in claim 6 wherein said cover comprises a planar rectangular front member, a planar rectangular top member having one edge thereof secured to a front edge of said front member, and two planar triangular side members, each said side member having two side edges respectively secured to a front and top member, said side members adapted to overlie the sides of said housing and forming a light seal therewith.

* * * * *